US007406918B2

(12) United States Patent
Brent et al.

(10) Patent No.: US 7,406,918 B2
(45) Date of Patent: Aug. 5, 2008

(54) METHOD OF BLASTING

(75) Inventors: Geoffrey Frederick Brent, Valentine (AU); Michael John Noy, Warners Bay (AU); Dane Peter Blair, Lakelands (AU)

(73) Assignee: Orica Explosives Technology Pty Ltd., Victoria (AU)

( * ) Notice: Subject to any disclaimer, the term of this patent is extended or adjusted under 35 U.S.C. 154(b) by 0 days.

(21) Appl. No.: 11/704,248

(22) Filed: Feb. 9, 2007

(65) Prior Publication Data

US 2007/0199468 A1 Aug. 30, 2007

Related U.S. Application Data

(63) Continuation of application No. 10/469,093, filed as application No. PCT/AU02/00054 on Jan. 18, 2002, now abandoned.

(30) Foreign Application Priority Data

Jan. 19, 2001 (AU) ..... PR2628

(51) Int. Cl.
*F42D 1/06* (2006.01)
*F42D 3/04* (2006.01)

(52) U.S. Cl. ..... 102/312; 102/301; 102/313; 175/57; 299/13

(58) Field of Classification Search ..... 102/311, 102/312, 313, 320, 301, 302, 305; 299/10, 299/18, 13; 175/2, 4.55, 57
See application file for complete search history.

(56) References Cited

U.S. PATENT DOCUMENTS

| | | | |
|---|---|---|---|
| 2,772,632 | A | 12/1956 | Aitchison et al. |
| 3,295,445 | A | 1/1967 | Ball et al. |
| 3,714,895 | A | 2/1973 | Rawson |
| 3,848,927 | A | 11/1974 | Livingston |
| 4,646,640 | A | 3/1987 | Florin et al. |
| 4,725,991 | A | 2/1988 | Crenwelge, Jr. et al. |
| 4,976,199 | A | 12/1990 | Beukes et al. |
| 5,140,907 | A | 8/1992 | Svatek |
| 5,194,689 | A | 3/1993 | Cummins |
| 5,388,521 | A | 2/1995 | Coursen |
| 5,413,047 | A | 5/1995 | Evans et al. |
| 5,539,636 | A | 7/1996 | Marsh et al. |
| 6,220,167 | B1 | 4/2001 | Yamamoto et al. |
| 6,422,147 | B1 | 7/2002 | Shann et al. |
| 6,460,462 | B1 | 10/2002 | Rosenstock et al. |
| 6,772,105 | B1 | 8/2004 | Heck, Sr. |

FOREIGN PATENT DOCUMENTS

| | | | |
|---|---|---|---|
| AU | 46309/99 | A | 1/2000 |
| AU | 200028890 | A | 10/2000 |
| AU | 200053560 | A | 3/2001 |
| SU | 1490419 | | 6/1989 |
| WO | WO-00/02005 | | 1/2000 |

OTHER PUBLICATIONS

Derwent Abstract Accession No. 87-197101-28, SU 1205643 A, (Shochinskii Mining Inst) Dec. 15, 1986.

*Primary Examiner*—James S Bergin
(74) *Attorney, Agent, or Firm*—Birch, Stewart, Kolasch & Birch, LLP

(57) ABSTRACT

A method of blasting in which rock pile profile associated with a blast field is controlled by precise control of the detonation delay times between and/or within individual blastholes in the blast field, in combination with the control of one or more other blast parameters. One or more of the blast parameters may by blasthole geometry, explosive charge or blast initiation location.

16 Claims, No Drawings

METHOD OF BLASTING

This application claims the priority of application Ser. No. 10/469,093, filed Dec. 15, 2003 now aboandoned, which claims priority of Australian Application No. PR2628 filed Jan. 19, 2001 and PCT/AU02/00054, filed on Jan. 18, 2002, respectively.

BACKGROUND OF THE INVENTION

1. Field of the Invention

The present invention relates to a method of blasting using an adjustable, highly precise blasthole initiation system in combination with specific aspects of blast design to provide improved blast results, more specifically to control the rockpile (muckpile) profile associated with a blast.

2. Description of the Related Art

Blasting operations produce rockpiles of material which is thrown (or displaced) by the blast. The characteristics of the rockpile profile (e.g. shape and displacement) produced influences the extent of excavation subsequently required, as well as the productivity of that excavation. It would be desirable to provide a method of blasting which allows the rockpile profile associated with a blast to be controlled and optimised, thereby allowing the efficiency associated with the blasting operation to be significantly enhanced by improved excavator productivity. It would also be desirable to control and tailor the particular rockpile profile associated with a blast to the mine excavation system associated with a particular blast site.

SUMMARY OF THE INVENTION

In accordance with the present invention it has now been found that these benefits may be achieved by precise control of certain aspects of blast design. More specifically, the present invention provides a method of blasting in which rockpile profile associated with a blast field is controlled by precise control of the initiation/detonation delay times between and/or within individual blastholes in the blast field, in addition to the control of one or more other important blast parameters, in particular the blasthole geometry, explosive charge and blast initiation location. This approach is fundamentally different from conventional blasting techniques which neither provide the adjustable delay times and high precision required nor generally vary the blasthole geometry, explosive charge and/or blast initiation location over a blast field specifically for the purpose of controlling the rockpile profile. In conventional blasting techniques most blasthole characteristics are generally designed to be constant over the entire blast field, or over large sections of the blast field. It has now been found that particular combinations of delay times, using highly precise initiation systems, and one or more of blast geometry, explosive charge and blast initiation location, applied as required differentially to various parts of the blast field, enable tailoring of the muckpile.

DETAILED DESCRIPTION

In accordance with the present invention precise control of blast delay time means control within a tolerance of less than one millisecond of the required and intended delay time between adjacent blastholes and/or within individual blastholes. This degree of control may be achieved using an electronic initiation system, as opposed to conventionally used non-electronic initiation systems. In one aspect of the invention it has been found that electronic initiation systems allow highly precise control of the delay between and/or within individual blasthole firings over the blast field and, in turn, this provides enhanced flexibility with respect to blast design such that the benefits of the present invention may be achieved. In addition, these systems are programmable and so provide the capability to obtain the required delay times, as opposed to conventional systems, which generally have a limited range of fixed delay times.

Typically, in accordance with the present invention the blast field is made up of a number of blastholes, and the invention resides in controlling the characteristics of the blastholes, particularly the blasthole diameter, geometry and explosive charge contained, in combination with precise control of the detonation delay between and/or within the blastholes, In the following the invention will be illustrated by reference to this kind of blast field. It has been found that precise control of the delay between blasthole firings allows the effect of other aspects of blast design on rockpile profile to be manipulated and optimised. Any one or more of the blasthole characteristics may be employed in combination with precise firing delay control in order to achieve the desired rockpile in a given situation.

In accordance with the present invention it is possible to control the magnitude of displacement of the rockpile in a particular direction and in selected zones of the blast to achieve a desired rockpile profile. Thus, the profile may be flattened or displaced forwards in certain areas or, alternatively, made to heave upwards or be minimally displaced in other areas as required to suit the mine excavation system. These possibilities are achieved in accordance with the present invention by designing the blast based on a high level of precision of control, as made available for example by the use of an electronic initiation system, in addition to the use of specific blast parameters.

Enhancement (increase) of rockpile displacement in a desired direction may be achieved by manipulating the inter-hole delay between blastholes, as well as the in-hole initiation within specific blast geometries. In accordance with the present invention these delays are controlled with great precision by using an adjustable, highly precise initiation system such as an electronic initiation system. Specific blast geometries to enhance the rockpile displacement in a particular direction include the use of an optimised blasthole pattern which is preferably a staggered pattern such that the ratio of inter-hole spacing along rows of blastholes (where the rows are taken to be perpendicular to the direction of required displacement) to the perpendicular distance between rows is in the range 1:2 to 3:2 and, preferably, in the range 7:10 to 6:5. Most preferably the ratio is in the range 7:10 to 1:1. The rows are preferably drilled parallel to any pre-existing or newly-created free faces in the blast field which are perpendicular to the desired direction of displacement. The blasthole orientation may also be manipulated to enhance rockpile displacement. In this embodiment the blastholes are generally inclined with the hole toe upwards in the same direction as the required displacement at an acute angle to the vertical, typically in the range up to 45 degrees. The explosive masses and energies within the blastholes may also be manipulated to control rockpile displacement. Usually, for maximum displacement the explosive masses and energies are maximised within the constraints of local environmental considerations, such as the avoidance of excessive vibration or overpressure levels and hazardous rock ejections.

Within such blast geometries, the displacement in a desired direction may be increased by the use of highly precise short inter-hole delays along rows of blastholes (where the rows are generally perpendicular to the desired direction of displacement). Specifically the inter-hole delays are typically from 0 to 4 ms per metre of inter-hole spacing (where the spacing is defined as the hole separation in such rows). The precise delay interval chosen may depend upon factors such as rock type and condition, and blast geometry. In a preferred embodiment the inter-hole delays are from 0 to 2 ms per metre of inter-hole spacing for most rock types. The specific inter-hole delay chosen from this range is the shortest delay possible that does not provide excessive vibration or blast damage. Use of a highly precise delay system, such as an electronic initiation system, allows these delays to be controlled to within a tolerance of less than one millisecond.

A further aspect of the invention for regions where muckpile displacement is to be enhanced is to use two or more such high precision initiators within each blasthole with a delay of two milliseconds or less, preferably zero, between them. Preferably one of these initiators is located close to the bottom, or toe, of the blasthole and the others are located further up the explosive column at regular intervals.

In addition, it has been found that rockpile displacement in the direction perpendicular to the rows is enhanced by the use of selected ratios of time delay between rows of holes (the inter-row delay) to the delay between holes along a row (the inter-hole or intra-row delay). Typically, this ratio will be in excess of 5:1 and, preferably, in excess of 25:1.

The inter-hole delay time per metre of blasthole spacing is usually constant along each row, but may be varied, even between any pair of holes, The inter-row delay time per metre of rockpile burden may be kept constant or varied from row to row according to the muckpile profile required. The position of the primary initiator within blastholes and the delay between in-hole initiators within blastholes may also vary throughout the blast, according to the muckpile profile required.

In another embodiment of the invention, in order to provide a particular rockpile profile suited to a mine excavation method, the design features mentioned above may be employed in areas of the blast where a flatter rockpile profile is required, or increased displacement in the desired direction. Conversely, in areas of the blast where a steeper profile is required, or decreased displacement in a selected direction, this is achieved by quite different manipulations of the delay between and/or within blastholes within different specific designs of blast geometry, explosive charge and/or blast initiation location.

Specific blast geometries to reduce the displacement in a particular direction include using a blasting pattern which preferably has larger spacing and burden distances than that used in areas where increased displacement is required. A similar effect may also be achieved by using as small a blasthole as possible while maintaining adequate rock fragmentation for subsequent mechanical excavation. The blasthole diameter may be reduced from that used in areas where increased displacement is required. The orientation of the blastholes may also have an influence on the displacement observed. Thus, in areas where reduced displacement is required the blastholes may be inclined at reduced angles to the vertical when compared with those areas in which increased displacement is required. The blastholes may be inclined at acute angles to the vertical as shallow as possible, including being angled away from the blast free face, while still effecting adequate rock fragmentation for excavation. The explosive masses and energies may be reduced to provide reduced displacement when compared with those areas in which increased displacement is required. The minimum explosive mass and energy must be used to effect sufficient rock fragmentation for subsequent mechanical excavation. Within such blast geometries, the displacement in a particular direction may be decreased by the use of inter-hole delays along rows of holes greater than the inter-hole delays along rows where increased displacement is required. Typically, for areas requiring reduced displacement the inter-hole delay will be in the range 4 to 40 ms, for example 20 to 40 ms, per metre of inter-hole spacing. The preferred delay between holes in these areas is the longest delay that does not result in problematic disruption of later firing blastholes.

In addition, displacement may be decreased further by using a ratio of delays between rows of holes (the inter-row delay) to the delays between holes along a row (the inter-hole or intra-row delay) which is lower than the corresponding ratio for areas in which increased displacement is required. Typically, for decreased displacement this ratio is in the range of 5:1 or less. The blast, or region of the blast where reduced displacement is required, may also be initiated at locations distant from any pre-existing free faces, hence initiating the blast, or region of the blast, from the back towards the front. Multiple blast initiation locations may thus be used, in contrast to conventional practice, which seldom uses more than one blast initiation location.

A particular refinement of the method of the invention, especially for use in areas where the full displacement of the rockpile is to be maximised, such as in cast blasting, without causing environmental problems such as excessive overpressure is to use longer inter-hole delays, preferably greater than 4 ms per metre of blasthole spacing in all or part of the front (or first firing) one or two rows and reverting to high precision shorter inter-hole delays (as specified above in the range 0 to 4 ms per metre of inter-hole spacing) in the latter part of the row or in subsequent rows.

Practical applications of the present invention include maximising the extent of material cast (or "thrown") to a final spoil position whilst simultaneously minimising the amount of material required to be rehandled by the excavator in producing interim platforms or surfaces from which to operate for further excavation. This enables the total amount of material to be handled by the excavator to be minimised, particularly in dragline operations. Such muckpile profiles may be optimally achieved through the application of differential blast design throughout the blast field as described herein.

In accordance with the present invention, the overall displacement of the rockpile in the final direction of spoil may also be increased to increase the overall productivity of excavation by decreasing the distance through which material is moved by the excavator. The invention may also be used to provide flatter, more spread out rockpiles for improving front-end loader productivity. Conversely, the invention may be used to provide steeper or taller rockpiles for improving productivity of certain equipment such as face shovels, or for increasing the rockpile voidage to enable easier digging. The invention may also be used to limit rockpile displacement in ore mines to enable improved ore/waste delineation and to maximise the concentration of ore recovered from the blast. The excavation process may also be enhanced by providing rockpiles in which a desired portion of the rockpile is located to provide easy equipment access while simultaneously providing an increased extent of material cast to final spoil in other parts of the rockpile.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The claims defining the invention are as follows:

1. A method of blasting in which rockpile profile of a blast field is tailored by control of rockpile displacement over the blast field as a result of blasting, this control being achieved by precise control of detonation delay times between individual blastholes in the blast field in combination with the control of one or more other blast parameters, wherein rockpile displacement in a desired direction is increased by the use of inter-hole detonation delays along rows of blastholes, the rows being generally perpendicular to the desired direction of displacement, of up to 4 ms per meter of hole separation in such rows.

2. A method according to claim 1, wherein rows of blastholes are drilled parallel to any pre-existing or newly-created free faces in the blast field which are perpendicular to the desired direction of rockpile displacement.

3. A method according to claim 1, wherein rockpile displacement in a particular direction is increased by use of a blasthole pattern in which the blastholes are staggered such that the ratio of inter-hole spacing along rows of blastholes, the rows being generally perpendicular to the desired direction of displacement, to perpendicular distance between rows is in the range 1:2 to 3:2.

4. A method according to claim 1, wherein the detonation delay times are controlled using an electronic initiation system.

5. A method according to claim 4, wherein the electronic initiation system is programmable.

6. A method of blasting in which rockpile profile of a blast field is tailored by control of rockpile displacement over the blast field as a result of blasting, this control being achieved by precise control of detonation delay times between individual blastholes in the blast field in combination with the control of one or more other blast parameters, wherein rockpile displacement in a direction perpendicular to a row of blastholes is increased by use of selected ratios of inter-row detonation delay time between rows of holes to the inter-hole detonation delay time between holes along a row, this ratio being in excess of 5:1.

7. A method of blasting in which rockpile profile of a blast field is tailored by control of rockpile displacement over the blast field as a result of blasting, this control being achieved by precise control of detonation delay times between individual blastholes in the blast field in combination with the control of one or more other blast parameters, wherein rockpile displacement in a blast field comprising at least three rows of blastholes is maximized without causing environmental problems by use of inter-hole detonation delay times of greater than 4 ms per meter of blasthole spacing in all or part of the front one or two rows and by use of inter-hole detonation delay times of up to 4 ms per meter of inter-hole spacing in a latter part of the row or subsequent rows of blastholes.

8. A method of blasting in which rockpile profile of a blast field is tailored by control of rockpile displacement over the blast field as a result of blasting, this control being achieved by precise control of detonation delay times between individual blastholes in the blast field in combination with the control of one or more other blast parameters, wherein rockpile displacement in a particular direction is increased by use of inter-hole detonation delays along rows of blastholes of up to 4 ms per meter of hole separation in such rows, and by use of selected ratios of inter-row detonation delay time between rows of holes to the inter-hole detonation delay time between holes along a row, this ratio being in excess of 5:1.

9. A method according to claim 8, wherein rockpile displacement in a particular direction is increased by use of a blasthole pattern in which the blastholes are staggered such that the ratio of inter-hole spacing along rows of blastholes, the rows being generally perpendicular to the desired direction of displacement, to perpendicular distance between rows is in the range 1:2 to 3:2.

10. A method of blasting in which rockpile profile of a blast field is tailored by control of rockpile displacement over the blast field as a result of blasting, this control being achieved by precise control of detonation delay times between individual blastholes in the blast field in combination with the control of one or more other blast parameters, wherein rockpile displacement is decreased by using a ratio, of inter-row detonation delay time between rows of holes to the inter-hole detonation delay time between holes along a row which is lower than the corresponding ratio for areas in which increased displacement is required.

11. A method according to claim 10, wherein rockpile displacement is decreased by using a ratio of inter-row detonation delay time in the range of 5:1 or less.

12. A method of blasting in which rockpile profile of a blast field is tailored by control of rockpile displacement over the blast field as a result of blasting, this control being achieved by precise control of detonation delay times between individual blastholes in the blast field in combination with the control of one or more other blast parameters, wherein rockpile displacement in a particular direction is decreased by use of a blasthole patted in which the blastholes are staggered such that the ratio of inter-hole spacing along rows of blastholes, the rows being generally perpendicular to the desired direction of displacement, to perpendicular distance between rows is in the range 1:2 to 3:2, by use of inter-hole detonation delays along rows of blastholes of from 4 to 40 ms per meter of hole separation in such rows, and by use of selected ratios of inter-row detonation delay time between rows of holes to the inter-hole detonation delay time between holes along a row, this ratio being 5:1 or less.

13. A method of blasting in which rockpile profile of a blast field is tailored by control of rockpile displacement over the blast field as a result of blasting, this control being achieved by precise control of detonation delay times between individual blastholes in the blast field in combination with the control one or more other blast parameters, wherein rockpile displacement is controlled by precise control of detonation delay times between individual blastholes in a blast field in combination with control of at least one blast parameter selected from blasthole diameter, blasthole orientation, explosive mass, explosive energy and inter-hole detonation delay, and wherein the rockpile displacement in a particular direction is decreased by use of inter-hole detonation delays along rows of blastholes greater than the inter-hole detonation delays along rows where increased displacement is required.

14. A method according to claim 13, wherein the inter-hole detonation delay is in the range 4 to 40 ms per meter of inter-hole spacing to produce decreased rockpile displacement.

15. A method according to claim 13, wherein rockpile displacement is controlled by blast initiation location, reduced rockpile displacement being achieved by blast initiation distant from any pre-existing free faces in the blast field.

16. A method according to claim 13, wherein reduced rockpile displacement is achieved by blast initiation from the back towards the front of the blast field.

* * * * *